US005669643A

United States Patent [19]

Räuber et al.

[11] Patent Number: 5,669,643

[45] Date of Patent: Sep. 23, 1997

[54] DEVICE FOR EMPTYING TRASH BARRELS INTO A WASTE COLLECTION VEHICLE

[75] Inventors: Ralf Räuber, Langerringen; Rudolf Motsch, Kissing, both of Germany

[73] Assignee: Otto Lift-Systeme GmbH, Köln, Germany

[21] Appl. No.: 519,319

[22] Filed: Aug. 25, 1995

[30] Foreign Application Priority Data

Aug. 26, 1994 [DE] Germany ..... 44 30 260.6
Aug. 26, 1994 [DE] Germany ..... 9415505 U

[51] Int. Cl.[6] ..... B65F 3/02

[52] U.S. Cl. ..... 294/1.1; 294/90; 294/902; 414/408

[58] Field of Search ..... 294/1.1, 68.1, 294/68.2, 68.26, 68.3, 90, 902; 414/607, 622, 406, 408, 419–421; 220/694

[56] References Cited

U.S. PATENT DOCUMENTS

| | | | |
|---|---|---|---|
| 3,663,052 | 5/1972 | Schurch | 294/68.26 |
| 4,243,354 | 1/1981 | Garcia | 294/90 |
| 5,149,243 | 9/1992 | Naab et al. | 414/408 |

FOREIGN PATENT DOCUMENTS

| | | |
|---|---|---|
| 0 235 784 | 9/1987 | European Pat. Off. . |
| 0 163 859 | 11/1989 | European Pat. Off. . |
| 0 354 256 | 6/1993 | European Pat. Off. . |
| 21 46 653 | 1/1974 | Germany . |
| 25 15 929 | 10/1983 | Germany . |
| 3 614 328 | 10/1987 | Germany . |
| 37 03 034 | 4/1988 | Germany . |

*Primary Examiner*—Dean Kramer
*Attorney, Agent, or Firm*—Darby & Darby

[57] ABSTRACT

A device for emptying trash barrels into a waste collection truck is provided on the lift-and-tip mechanism of the waste collection truck with a grab unit (12) for picking up the trash barrels, several upward pointing claws (14), with recesses (15) between them, provided on the grab unit (12) for insertion under a grip ledge designed essentially as an inverted U-channel protruding outwards from the side wall of the respective trash barrel at or near its upper rim, and a lower stay serving to brace the trash barrel suspended on the grab unit (12). In this device, a lower section (16) of the claw (14) is attached in stationary fashion to the grab unit (12) and an upper section (44) of the claw (14) is movably attached to the lower section (16) in such fashion that, in positions away from the lower section (16), the upper section (44) is freely movable relative to the lower section in the direction (68) to and from the barrel and that, in a position of minimum distance from the lower section (16), the upper section (44) is not movable relative to the lower section (16), there being only one such position of minimum distance between the upper section (44) and the lower section (16).

23 Claims, 4 Drawing Sheets

DEVICE FOR EMPTYING TRASH BARRELS INTO A WASTE COLLECTION VEHICLE

FIELD OF THE INVENTION

This invention relates to a device for emptying trash barrels into a waste collection and disposal truck. Such a device incorporates for instance a pickup unit, or grab, on the lift-and-tip mechanism of a waste disposal truck which grab is designed to lift and move one or several trash barrels even of varying sizes into the waste disposal truck. The variation in the position of the lift-and-tip mechanism relative to the waste disposal truck respectively defines the vehicle as a rear loading, front-end loading or side loading truck. The grab must be configured to match the shape of the trash barrels to be emptied. This means that, in addition to the grab on the lift-and-tip mechanism, the device concept must include corresponding grips on the trash barrel.

BACKGROUND OF THE INVENTION

The German patent 21 46 653 describes a device of the type mentioned above. The grab on the lift-and-tilt mechanism of the waste disposal truck incorporates several upward claws, alternating with recesses in between, on a pickup cleat. This pickup cleat engages, from below, in a ledge on the barrel which ledge is a channel molding with a cross section essentially like an inverted U. The ledge protrudes along one side of the trash barrel either on or near the barrel rim. This allows the claws of the grab to reach under the said ledge into the channel. The pickup cleat is provided with an array of multiple claws, enabling it to pick up trash barrels of different sizes by their respective ledges and to empty them in random order.

The German patent 25 15 929 goes beyond that in describing a device in which the pickup cleat is subdivided into two side-by-side cleats in a way that larger trash barrels as well, suspended on both pickup cleats, can be lifted and emptied at the same time. For emptying such larger trash barrels, both cleats, along with the two corresponding lift-and-tip mechanisms, are-moved in synchronous fashion.

In all of these earlier devices, the grabs are provided not only with claws which hold the barrel or barrels but also with lower stays which brace the barrel body or bodies.

In these waste pickup systems the claws engage firmly in the barrel grip. As they insert themselves from underneath into the U-shaped ledge of the trash barrel, they pull the barrel up close if and when the barrel with its U-ledge is not positioned precisely above the claws. Since the claws are designed essentially in the form of plates with more or less vertical outer surfaces, there is very little relative lateral movement between the claw and the barrel as is necessary for the claw to slip into the U-channel. This minimizes the stress on the outer wall of the U-channel which can result from off-center engagement of the claw in the U-channel.

By contrast, in the trash barrel design per European patent B1-235 784 in which the ledge is in the form of a pocket that opens up downwards, the stress is considerably greater. This pocket is the only grip by which the grab can hold and lift the barrel. The pocket must therefore be relatively large which in turn means that there is room for only one such pocket on the front of the trash barrel. The pocket must support the barrel in all lifting and tilting positions since there is no lower stay that would brace the body of the barrel. Consequently, the pocket not only has to support the weight of the barrel contents but must also hold up to the shaking movement in the final phase of the tipping or tilting process. The pickup claw designed to engage in this pocket is movably attached to a swivel arm of the grab unit. By a more or less significant lateral swiveling movement or extension of the swivel arm the pickup claw can thus home in on the pocket from below. The load on the pickup claw in the form of the trash barrel sitting on it causes the claw to move vertically downwards, locking it in its relative position and alignment. The claw itself is configured as an isosceles-triangle plate which extends parallel with the barrel wall incorporating the pocket and whose upper two triangle corners form beveled gripping surfaces that taper inwards on the far side from the barrel wall. The pocket has correspondingly backtapered surface sections provided on a molding that reinforces the rim at the open end of the trash barrel. Since there is only one single pocket on the trash barrel while there are no stays helping to brace the barrel body, the edge of the pocket is exposed to a considerable load stress both when the pickup claw inserts itself in off-center fashion in the pocket and when the barrel is lifted and emptied.

The German patent 37 03 034 describes a proposed way to avoid damage to a pocket of this type in that the pocket is made up of several, mutually parallel wall sections which are connected with one another by reinforcing braces, for instance in a thombold or honeycomb vaulted configuration.

OBJECT AND SUMMARY OF THE INVENTION

Given the prior art described above, this invention is aimed at providing an improved device for the emptying of trash barrels, in which the stress on the grip ledge or channel of the barrel is minimized while still permitting easy pickup of trash barrels by the lift-and-tip mechanism of a waste collection and disposal truck.

The device according to this invention involves the redesign of the lift-and-tip mechanism of the truck and the appropriate adaptation of the grip ledge on the trash barrel.

The device according to this invention builds on a pickup cleat per earlier, existing designs incorporating several claws, its characteristic feature being that one single claw consists of a fixed lower section attached to the grab unit and an upper section movably attached to the lower section. The upper section is capable of moving both in the direction of and in relation to the lower section and at a right angle relative to the latter. In positions away from the lower section, the upper section can move freely in relation to the lower section both toward and away from the trash barrel, while in the other extreme position closest to the lower section it becomes immovable. There is only one such close-up position between the upper section and the lower section. This design allows the claw to essentially auto-center itself into the inverted U-channel or grip ledge of a trash barrel. It is only the upper section that is engaged in auto-centering fashion. The lower section remains in a position that may be off-center in relation to the longitudinal axis of the channel. In other words, when the claw is inserted from underneath into the channel of a trash barrel, the claw need not be precisely centered under the ledge. It is only important that the upper section enter into the throat of the channel. As the claw is pushed up, the upper section is able to move away from or toward the barrel so that, in free-floating fashion, it can engage over its entire surface in the channel. After all of the upper section is fully engaged in the channel inside which it makes full contact with the inner channel surfaces, the continued upward movement of the cleat causes the upper section to move in the direction of the lower section. The vertical distance between the upper section and the lower section is reduced and at the same time the upper section is moved horizontally into the vertical plane of the lower section. In the process, the trash barrel is pulled toward the lower section and thus into its intended lift-and-tip position. This lateral movement does not take place, however, when the claw is only partly engaged, for instance at the bottom rim of the pocket or channel, but only after the claw, i.e. its upper section, is fully engaged in, and has made full surface contact with, the inside of the channel or pocket of the trash barrel. In other words, the barrel is pulled toward the cleat and thus into the position in which it must be for proper alignment with the lift-and-tilt mechanism in terms of its distance from the pickup cleat. Its lateral position along the pickup cleat can be varied, as described in the aforementioned German patent 21 46 653. The device according to this invention thus permits gentle pickup of trash barrels to be emptied by virtue of the essentially auto-centering grab feature while still assuring precise alignment of the trash barrel with, and in, the lift-and-tip mechanism during the lift and tilt movement of the latter.

The upper section may be designed to allow movement relative to the lower section perpendicular to the pickup cleat or in the longitudinal direction of the pickup cleat which in the case of a rear-loading waste collection truck means perpendicular to the truck. Therefore, the pocket may be in the form of an essentially continuous channel in the longitudinal direction of the cleat, or in the form of a series of consecutive pocket-like recesses. Either configuration permits off-center engagement in the barrel along the length of the cleat. It thus also permits the pickup of barrels of varying widths in random order. Moreover, one trash barrel can be suspended on the claws of two side-by-side pickup cleats. In all these cases it is possible to position the barrel merely in rough proximity to the cleat, with the claws of the cleat inserting themselves from underneath into the channel of the trash barrel which need not be precisely aligned either. By contrast, with the design per prior art which uses a cleat with several claws, precise alignment of the barrel is virtually a must, which is why in many cases the operator manually hangs the barrel on the claws to make sure that the barrel is precisely aligned with the pickup cleat.

The features of specific design variations of the device according to this invention are described in the sub-claims and in the following example.

DESCRIPTION OF THE DRAWINGS

This invention is described and explained in more detail by means of the following design example, with the aid of the diagrams in which.

DETAILED DESCRIPTION OF THE INVENTION

Figure 1:
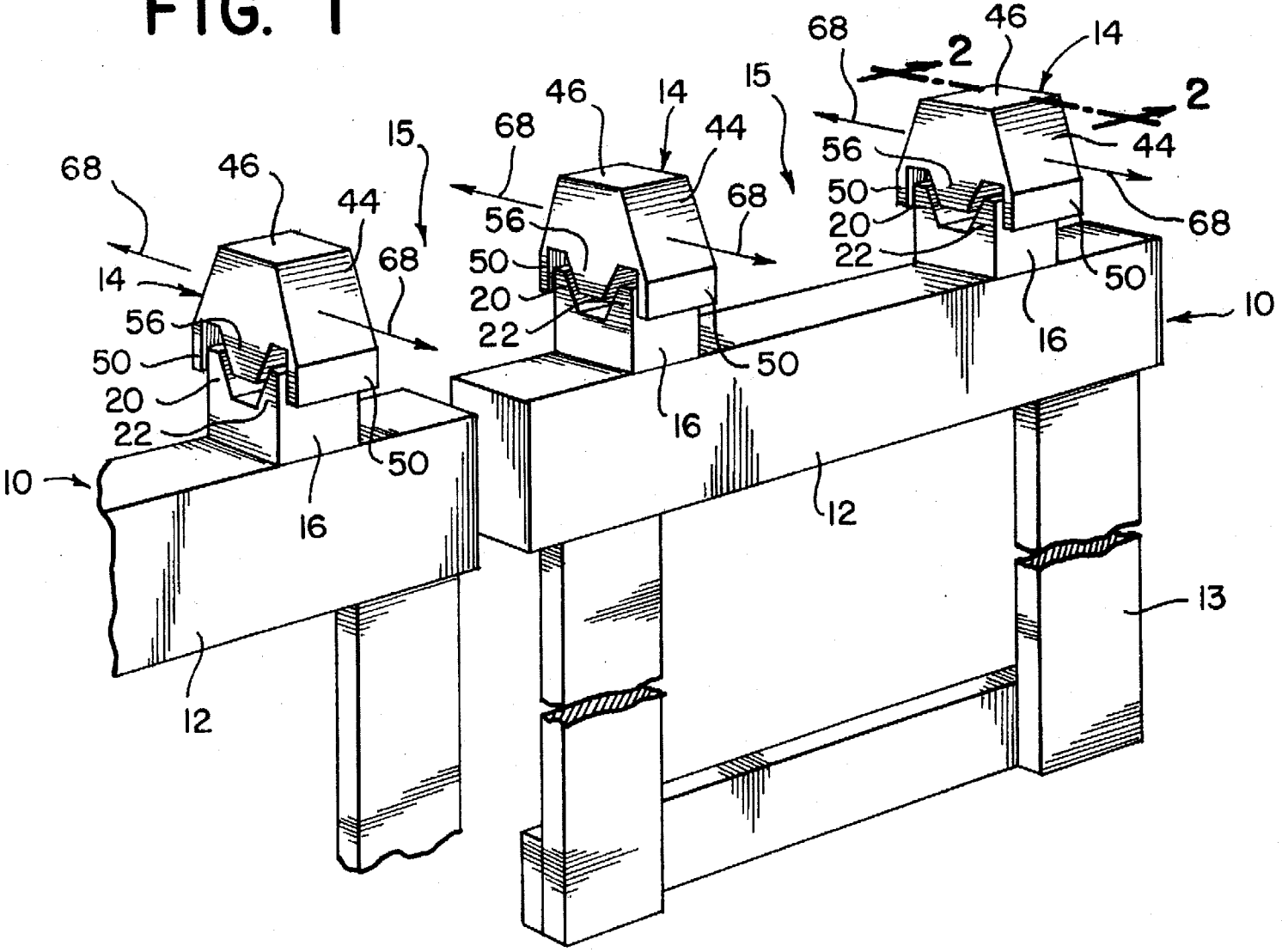
FIG. 1 shows two side-by-side cleats, with cogs facing upward, of two lift-and-tip mechanisms of a waste collection truck.

The cogged cleats 12 of two side-by-side grab units 10 on a waste collection truck are shown in schematic fashion in FIG. 1. From each cogged cleat 12 the cogs, hereinafter referred to as claws 14, jut upward. Between neighboring claws 14 the cogged cleat 12 is provided with gaps or recesses 15. The trash barrel to be emptied, with its grip ledge or channel, is suspended on two or more of these claws 14. In addition to the cogged cleat 12, the grab unit 10 is provided with a lower stay 13 serving to brace the lower part of the trash barrel hanging on the cogged cleat 12.

Each claw 14 incorporates a lower section 16 rigidly attached to the cogged cleat 12. From the sides of the lower section, support walls 20, 22 extend upwards with each support wall 20, 22 having a cross section that tapers upward in that its inner wall surface 24 obliquely recedes in an upward direction toward the outside. In the example shown, the inner wall surfaces 24 are connected at the bottom by a base surface 26.

In the base 26, a perforation 28 tapers downward. This conical perforation ends in a cutout 30 in a way as to form in the latter a retaining shoulder 32. This shoulder 32 serves as a support rim for the washer 38 which is attached to a bolt 36 with a nut 34. The bolt protrudes upward through the perforation 28 and its spherical head 40 at the upper end butts from below against a roof-shaped central cavity 42 machined into an upper section 44.

Figure 4:
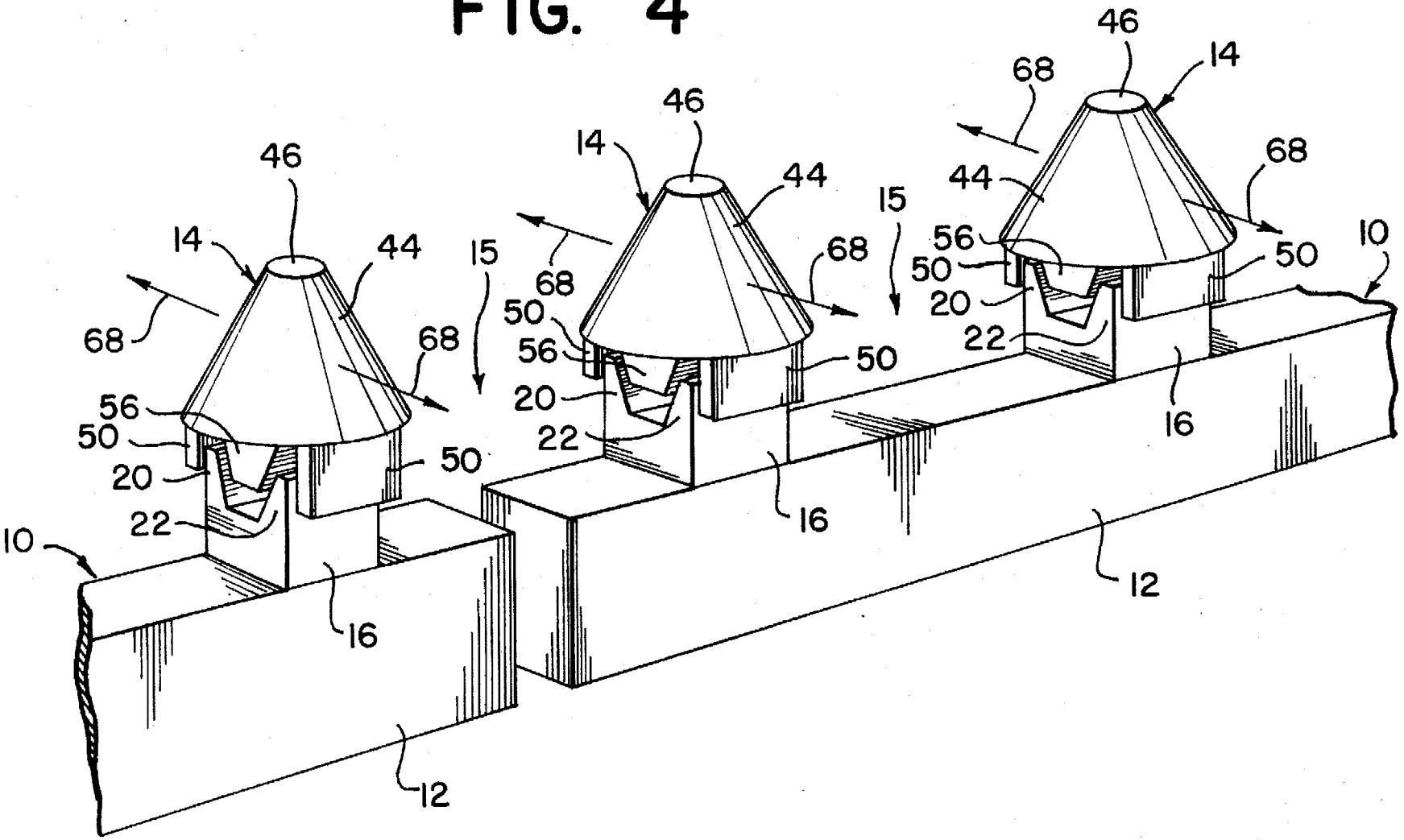
FIG. 4 shows the claws as radially symmetric.

The said upper section has an outer, i.e. lateral and top, surface 46 the cross section of which describes a truncated cone. Every claw 14 is configured with the same upper cross section 44 which is symmetrical in all parallel planes along the cogged cleat 12, and all claws 14 are identical. It is also possible, however, to make the surface 46 radially symmetrical, for instance cone-shaped, as shown in FIG. 4.

The grip ledge or channel on the trash barrel which is to be picked up by the claws 14 is configured in a shape that corresponds to the surface 46. Accordingly, the inner surface of the channel is shaped in a way that the surfaces 46 of the claws 14 make full contact with the corresponding inner walls inside the channel and/or with reinforcing crosspieces contained therein.

Projecting downward from the upper section 44 are lateral walls 50 which, when the upper section 44 is centered above the lower section 16, are positioned at a distance 52 from the outer surface 54 of the support walls 20, 22. The spacing 52 is symmetrical on all sides. In the inside area surrounded by the support walls 20, 22 the upper section 44 has a central, downward protrusion 56 which incorporates the central cavity 42.

Attached to the bottom of the protrusion 56, with screws 58, is an element 60 by means of which the spherical head 40 can be pressed against the cavity 42. The upper section 44 can be swiveled in relation to the spherical head 40.

Between the protrusion 56, i.e. its outer surfaces 57, and the support walls 20, 22, spaces or gaps 62 are again provided which are identical in size when the upper section 44 is centered above the bottom section 16.

A helical spring 64 positioned between the element 60 and the base 26 serves to push the element 60 and thus the upper section 44 away from the base 26 and thus from the lower section 16.

Figure 2:
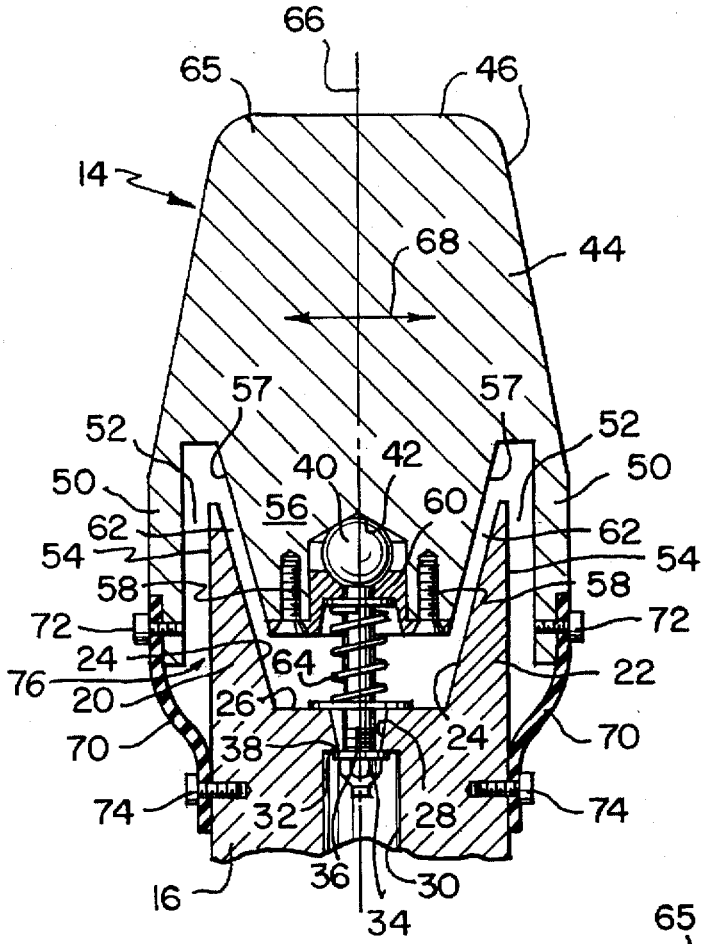
FIG. 2 shows a cross section through a claw along the line 2—2 in FIG. 1, the upper section of which claw is in a first extreme position.

The position of the upper section 44 illustrated in FIG. 2 reflects the no-load condition of the claw 14. When the lower section 16, and with it the cogged cleat 12, inserts itself from underneath into the inverted-U channel of a trash barrel, the cogged cleat 12 need be positioned underneath the channel just enough to allow the upper end 65 of the upper section 44 to engage in the channel. As the lower section 16 continues to move upward, the upper section 44 which can move freely in relation to the lower section 16 by the amount of space in the gap 62, can now adapt itself to the respective position of the barrel and its grip ledge or channel. In that manner, the upper section 44 can fully insert itself into the channel, without stress and without force exerted on the latter.

Figure 3:
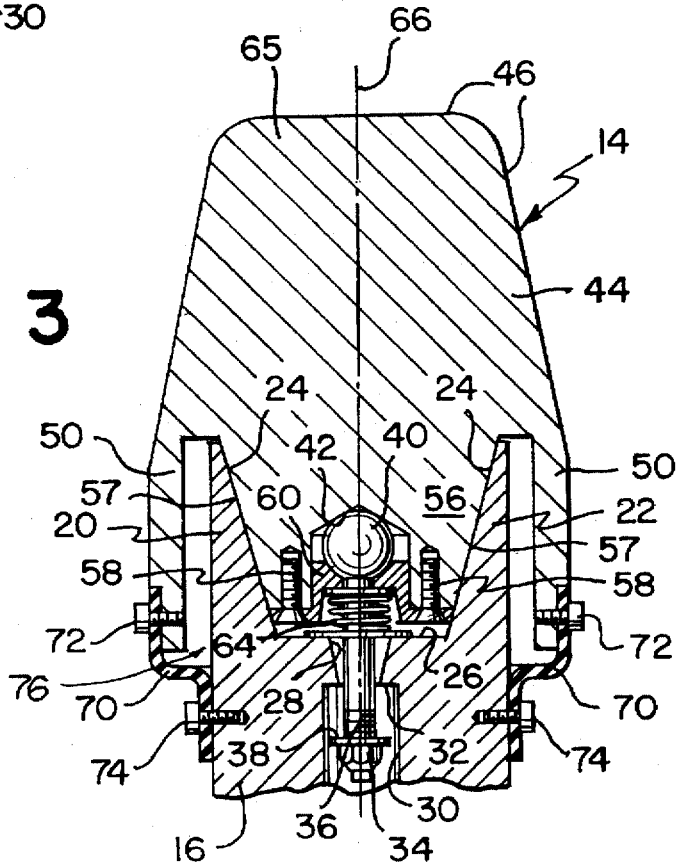
FIG. 3 shows a cross section as in FIG. 2, with the upper section of the claw in the extreme opposite position.

Once the upper section 44 is fully engaged in the channel, any continued upward movement of the lower section 16 will cause the protrusion 56 to butt against either the inner surface 24 of the support wall 20 or the inner surface 24 of the support wall 22. As the lower section 16 continues to rise, the upper section 44 is pushed downward along the sloped inner surface 24 and makes a horizontal movement perpendicular to the longitudinal axis 66 (see double arrow 68). In its final position, the upper section 44 will be as shown in FIG. 3, located centrally and precisely above the lower section 16.

In its horizontal movement (double arrow 68) the upper section 44 takes the channel and thus the associated trash barrel along with it. The force exerted on the barrel in the process can be absorbed by the channel without difficulty since the upper section 44 is fully engaged on the cleat, and sufficiently large contact surfaces between the trash barrel and the upper section 44 provide adequate load distribution. Consequently, the trash barrel, usually made of plastic, can absorb the stress to which it is exposed without damage. The forces present between the upper section 44 and the lower section-16 act only on a small surface area; however, they can be easily absorbed by the claws 14 and the cogged cleat 12 which are usually made of a sufficiently sturdy material such as metal.

The lateral walls 50 are connected to the lower section via a rubber sheet or other flexible sheet 70 by means for instance of the screws 72, 74. This provides a dust-proof enclosure for the gap 76 defined by the space 52 between the upper section 44 and the lower section 16. The screws 72, 74 must be countersunk so that there is no interference by protruding parts.

In order that the upper section 44 can be deflected laterally as shown in FIG. 2, the bolt 36 as well must permit lateral deflection from its vertical, central position shown in FIG. 2. This is made possible by virtue of the conical downward taper of the perforation 28 shown in the diagram. The bolt 36 also serves to prevent a complete detachment of the upper section 44 from the lower section 16. Such detachment is possible only by removing the nut 34 and the screw 72 or 74. When these are removed, the upper section 44, together with the bolt 36, can be lifted out of the lower section 16. By removing the screw 58 the element 60, together with the bolt 36, can be detached from the upper section 44.

Figure 5:
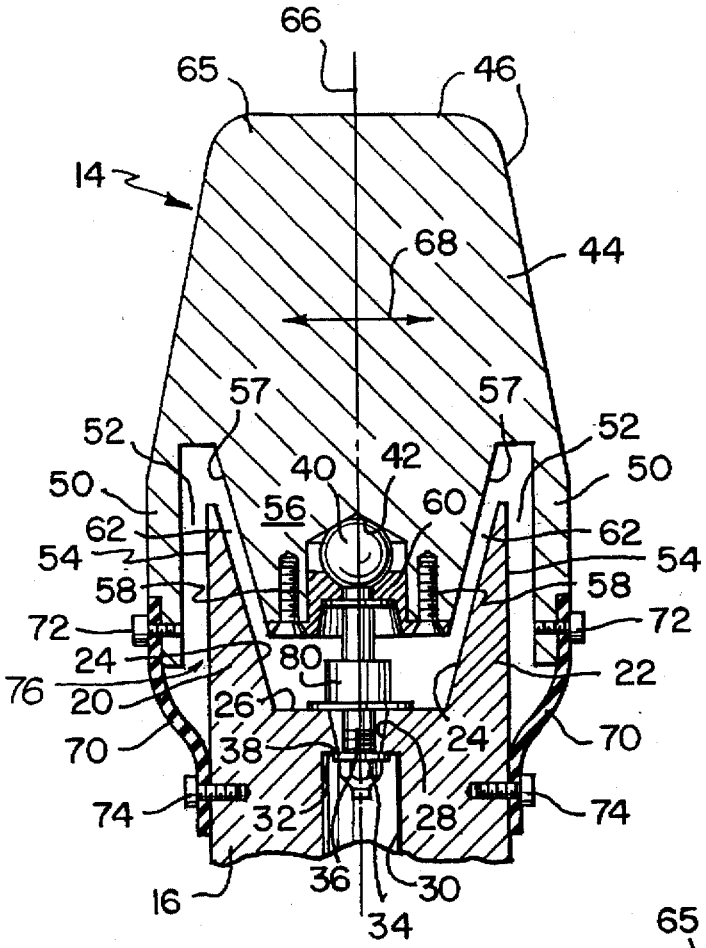
FIGS. 5 and 6 shows a second embodiment having a piston-and-cylinder assembly for keeping the upper and lower sections of the claw spaced apart.
Figure 6:
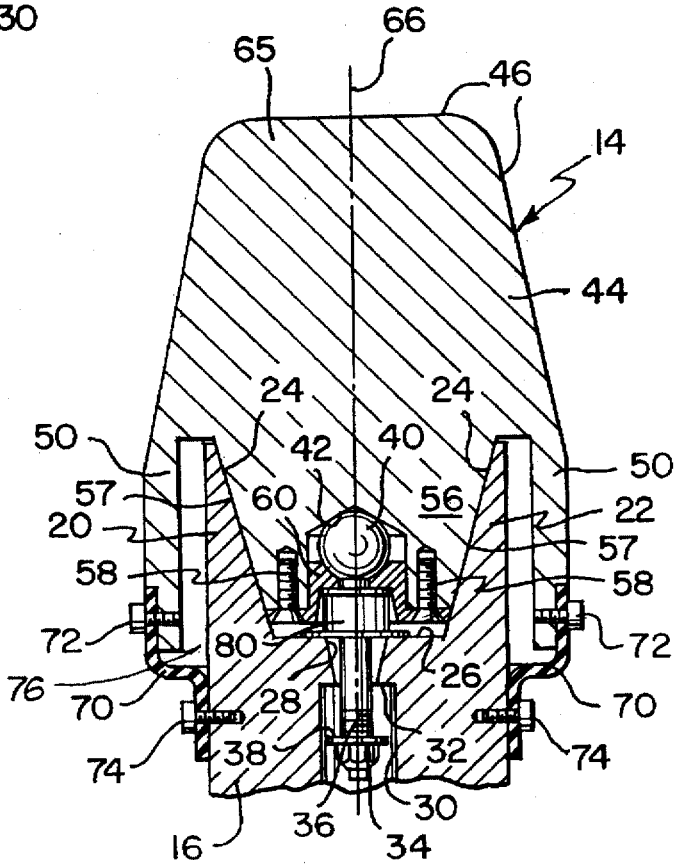

In place of the helical spring 64, other suitable elements such as shock absorbers 80 can be used. The shock absorbers may be regular hydraulic or pneumatic piston-cylinder configurations, as shown in FIGS. 5 and 6. By varying the pressure of the medium impinging on the piston one could vary the force with which the upper section 44 is pushed away from the lower section 16. By way of example, appropriate selection of the pressure parameters would make it possible to counter the risk of a shifting of the upper section 44 from its vertical alignment. In some cases, such shifting might be encountered when the upper section 44 tries to center itself above the lower section 16.

We claim:

1. A device for emptying a trash barrel using a lift-and-tip mechanism of a waste collection truck, the trash barrel being of the type having a grip ledge which protrudes outward from one side of the trash barrel, said device comprising:

a plurality &spaced, upward pointing claws for insertion under the grip ledge of a trash barrel, each claw having a lower section and an upper section, wherein:

the upper section has an upper free surface shaped to engage under the grip ledge of the trash barrel and a lower surface:

the lower section has an upper surface facing the lower surface of the upper section:

the lower surface of the upper section is maintained spaced above the upper surface of the lower section when the upper surface of the upper section is not engaging a grip ledge of a trash barrel:

the upper section is movably attached to the lower section such that the upper section is freely movable relative to the lower section when the lower surface of the upper section is spaced above the upper surface of the lower section: and the upper section is immovable relative to the lower section when the lower surface of the upper section is urged by the load of a trash barrel to a position of minimum distance from the upper surface of the lower section.

2. The device as in claim 1, wherein the upper section is movable in every direction in relation to the lower section when it is spaced from the lower section.

3. The device as in claim 1, further comprising at least one spacer provided between the upper section and the lower section, the spacer attempting to space the lower surface of the upper section from the upper surface of the lower section against the load of the trash barrel to a position of maximum distance from the upper surface of the lower section.

4. The device as in claim 3, wherein the spacer is an elastic, resilient element.

5. The device as in claim 3, wherein the spacer is a helical spring.

6. The device as in claim 3, wherein the spacer is a piston-and-cylinder assembly.

7. The device as in claim 6, wherein the piston and-cylinder assembly includes a hydraulic or pneumatic element.

8. The device as in claim 1, wherein;

the lower surface of the upper section has two contact surfaces which slope downward in a converging direction, and the upper surface of the lower section has inner surfaces which match said contact surfaces, said contact surfaces making full contact with said inner surfaces when the lower surface of the upper section is in the position of minimum distance from the upper surface of the lower section: and there is a variably large gap between said contact and inner surfaces when the upper section is in all other positions, the variably large gap being largest when the lower surface of the upper section is farthest away from the upper surface of the lower section.

9. The device as in claim 8, further comprising a protective sheet covering the outside of the variably large gap between the lower surface the upper section and the upper surface of the lower section.

10. The device as in claim 9, wherein the protective sheet is fastened to each of the upper and lower sections.

11. The device as in claim 1, further comprising a retaining member movably attached to both the lower and upper sections.

12. The device as in claim 11, further comprising a helical spring about said retaining member, said helical spring being disposed between the lower and upper sections and able to push the upper section in a direction away from the lower section.

13. The device as in claim 11, wherein the retaining member is a rod-shaped element mounted in the lower section to permit both longitudinal displacement and lateral deflection.

14. The device as in claim 11, wherein:

the retaining member has a spherical head: and the lower surface of the upper section has a cavity for receiving said spherical head, said device further comprising a clamp-like fastening element which holds said spherical head against the lower surface of the upper section within said cavity.

15. The device as in claim 1, wherein the lower surface of the upper section of each claw is mutually parallel to the upper surface of its respective lower section.

16. The device as in claim 1, wherein the lower surface of the upper section of each claw is radially symmetric.

17. The device as in claim 1, wherein the grip ledge of the trash barrel is essentially an inverted U-shaped channel and wherein the upper surface of the upper section is shaped so that when the upper section is fully engaged in the channel, no relative movement is possible between the upper section and the trash barrel in the direction to and from the trash barrel, while such relative movement between the upper section and the trash barrel is possible when the upper section is not fully engaged in the channel.

18. The device as in claim 1, wherein the grip ledge of the trash barrel is shaped to permit firm contact with the upper surface of the upper section.

19. The device as in claim 1, further comprising a lower support stay for bracing the trash barrel suspended on the grab unit.

20. The device as in claim 1, further comprising at least one cleat, the lower section of the plurality of claws being rigidly attached to one or more of the at least one cleat.

21. A device for emptying a trash barrel using a lift-and-tip mechanism of a waste collection truck, the trash barrel being of the type having a grip ledge which protrudes outward from one side of the trash barrel, said device comprising:

a plurality of spaced, upward pointing claws for insertion under the grip ledge of the trash barrel, each claw having a lower section and an upper section, the upper section being movably attached to the lower section such that the upper section is freely movable relative to the lower section when spaced from the lower section and is immovable relative the lower section when the upper section is urged by the load of the trash barrel to a position of minimum distance from the lower section; and at least one spacer provided between the upper section and the lower section, the spacer attempting to space the upper section from the lower section against the load of the trash barrel to a position of maximum distance from the lower section, the spacer comprising a piston-and-cylinder assembly.

22. A device for emptying a trash barrel using a lift-and-tip mechanism of a waste collection truck, the trash barrel being of the type having a grip ledge which protrudes outward from one side of the trash barrel, said device comprising:

a plurality of spaced, upward pointing claws for insertion under the grip ledge of the trash barrel, each claw having a lower section and an upper section, the upper section being movably attached to the lower section such that the upper section is freely movable relative to the lower section when spaced from the lower section and is immovable relative the lower section when the upper section is urged by the load of the trash barrel to a position of minimum distance from the lower section; and a retaining member movably attached to both the lower and upper sections, wherein the retaining member is a rod-shaped elements mounted in the lower section to permit both longitudinal displacement and lateral deflection.

23. The device as in claim 22, wherein the retaining member has a spherical head, and wherein the upper section has a cavity for receiving said spherical head, said device further comprising a clamp-like fastening element which holds said spherical head against the upper section within said cavity.

* * * * *

UNITED STATES PATENT AND TRADEMARK OFFICE

CERTIFICATE OF CORRECTION

PATENT NO. : 5,669,643

DATED : September 23, 1997

INVENTOR(S) : Ralf RÄUBER and Rudolf MOTSCH

It is certified that error appears in the above-identified patent and that said Letters Patent is hereby corrected as shown below:

Title page, [30], Foreign Application Priority Data, change "44 30 260.6" to --P 44 30 260.6--; and change "9415505 U" to --G 94 15 505.4--.

Signed and Sealed this

Ninth Day of December, 1997

*Attest:*

*Attesting Officer*

BRUCE LEHMAN

*Commissioner of Patents and Trademarks*